US007543898B2

(12) United States Patent
Matsuhashi

(10) Patent No.: US 7,543,898 B2
(45) Date of Patent: Jun. 9, 2009

(54) LIQUID EJECTION APPARATUS

(75) Inventor: Kunihiko Matsuhashi, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 227 days.

(21) Appl. No.: 11/514,948

(22) Filed: Sep. 5, 2006

(65) Prior Publication Data

US 2007/0052739 A1 Mar. 8, 2007

(30) Foreign Application Priority Data

Sep. 2, 2005 (JP) ..... 2005-255259

(51) Int. Cl.
*B41J 29/38* (2006.01)

(52) U.S. Cl. ..... 347/5; 347/8; 347/35

(58) Field of Classification Search ..... 347/5, 347/8–9, 12, 34–35
See application file for complete search history.

(56) References Cited

U.S. PATENT DOCUMENTS 5,270,738 A 12/1993 Takahashi et al.

FOREIGN PATENT DOCUMENTS

| | | | |
|---|---|---|---|
| EP | 0 671 274 | A1 | 9/1995 |
| JP | 2000-127362 | A | 5/2000 |
| JP | 2000-211159 | A | 8/2000 |
| JP | 2004-074611 | A | 3/2004 |
| JP | 2005-053021 | A | 3/2005 |

*Primary Examiner*—Lam S Nguyen
(74) *Attorney, Agent, or Firm*—Sughrue Mion, PLLC

(57) ABSTRACT

A liquid ejection apparatus includes a liquid ejection head, a liquid receiving member, a liquid receiving member moving mechanism, and a liquid ejection head moving mechanism. The liquid ejection head ejects liquid from liquid ejection nozzles in a nozzle surface to a target transported along a target transport surface opposed to the nozzle surface. A portion of the liquid receiving member receives the liquid ejected from the liquid ejection nozzles in flushing. The liquid receiving member moving mechanism moves the liquid receiving member until an opening faces the nozzle surface in printing, and until the liquid receiving portion faces the nozzle surface in the flushing. The liquid ejection head moving mechanism moves the liquid ejection head until the nozzle surface reaches a printing position close to the target transport surface in the printing and a flushing position spaced from the target transport surface in the flushing.

4 Claims, 3 Drawing Sheets

LIQUID EJECTION APPARATUS

CROSS-REFERENCE TO RELATED APPLICATIONS

This application is based upon and claims the benefit of priority from prior Japanese Patent Application No. 2005-255259, filed on Sep. 2, 2005, the entire content of which is incorporated herein by reference.

BACKGROUND

1. Technical Field

The present invention relates to a liquid ejection apparatus.

2. Related Art

As a typical liquid ejection apparatus ejecting liquid onto a target, an inkjet printer (hereinafter, referred to as a "printer") is generally known. The printer includes a recording head (a liquid ejection head) and an ink cartridge that supplies ink (liquid) to the recording head. The ink is then ejected from nozzles defined in the recording head onto a recording medium, which is a target, to subject the recording medium to printing.

In this printer, the nozzles of the recording head may be clogged through evaporation of solvent of the ink from the nozzles, which increases the viscosity of the ink and thus solidifies the ink. Clogging of the nozzles may be caused also by deposition of dust or generation of bubbles. These factors causing nozzle clogging lead to a printing problem. To solve this problem, the printer normally performs flushing, or forcible drainage of the ink from the nozzles independently from ejection of the ink onto the target.

Also, to enable high-speed printing, a large-sized full-line type printer has been proposed. This type of printer includes nozzles that are aligned along the entire width of a printing area and in a direction perpendicular to the transport direction of the recording medium. The weight of the recording head of the printer is thus increased, making it difficult to move the recording head out of the printing area for carrying out flushing. Accordingly, it is required that the flushing be accomplished without moving the recording head out of the printing area.

To meet the requirement, JP-A-2000-211159, for example, describes a printer having an auxiliary ejection cover (a liquid receiving member), which is arranged between a recording head and a recording medium. An opening sized in correspondence with the size of a nozzle surface is defined in the auxiliary ejection cover. The auxiliary ejection cover is reciprocated between a position at which the opening opposes the nozzle surface of the recording head and a position other than the position opposed to the nozzle surface. Specifically, to perform printing, ink is ejected from the recording head onto the recording medium through the opening of the auxiliary ejection cover. In flushing, the ink is ejected onto the opposing surface of the auxiliary ejection cover.

Normally, to enhance accuracy of printing, it is desirable to decrease the distance between the recording head and the recording medium. However, if the nozzle surface of the recording head is brought excessively close to the recording medium for the above purpose, the auxiliary ejection cover slides on the nozzle surface while being moved for flushing, causing a printing problem. Also, resistance may be caused against movement of the auxiliary ejection cover. Alternatively, if the distance between the recording head and the recording medium is increased (to 3 mm or greater, for example) to avoid generation of such sliding resistance, the ink ejected from the recording head through the opening of the auxiliary ejection cover may run on the recording medium, which also is a printing problem. Further, if some of the ink cannot be received by the recording medium, mist of the ink may generate.

SUMMARY

An advantage of some aspects of the present invention is to provide a liquid ejection apparatus that stably moves a liquid receiving member and maintains desired accuracy of liquid ejection onto a target.

According to an aspect of the invention, a liquid ejection apparatus including a liquid ejection head, a liquid receiving member, a liquid receiving member moving mechanism, and a liquid ejection head moving mechanism is provided. The liquid ejection head has a nozzle surface. A plurality of liquid ejection nozzles being provided in the nozzle surface. The liquid ejection head ejects a liquid from the liquid ejection nozzles to a target transported along a target transport surface opposed to the nozzle surface. An opening larger than the nozzle surface is formed in a portion of the liquid receiving member. A portion of the liquid receiving member other than the portion corresponding to the opening functions as a liquid receiving portion that receives the liquid ejected from the liquid ejection nozzles in flushing. The liquid receiving member moving mechanism moves the liquid receiving member along a movement plane defined between the nozzle surface and the target transport surface. In printing, the liquid receiving member moving mechanism moves the liquid receiving member until the opening faces the nozzle surface. In the flushing, the liquid receiving member moving mechanism moves the liquid receiving member until the liquid receiving portion faces the nozzle surface. The liquid ejection head moving mechanism moves the liquid ejection head to move the nozzle surface close to or separately from the target transport surface. In the printing, the liquid ejection head moving mechanism moves the liquid ejection head until the nozzle surface reaches a printing position close to the target transport surface. In the flushing, the liquid ejection head moving mechanism moves the liquid ejection head until the nozzle surface reaches a flushing position spaced from the target transport surface.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DESCRIPTION OF EXEMPLARY EMBODIMENTS

An embodiment of the present invention will hereafter be described with reference to FIGS. 1 to 4.

Figure 1:
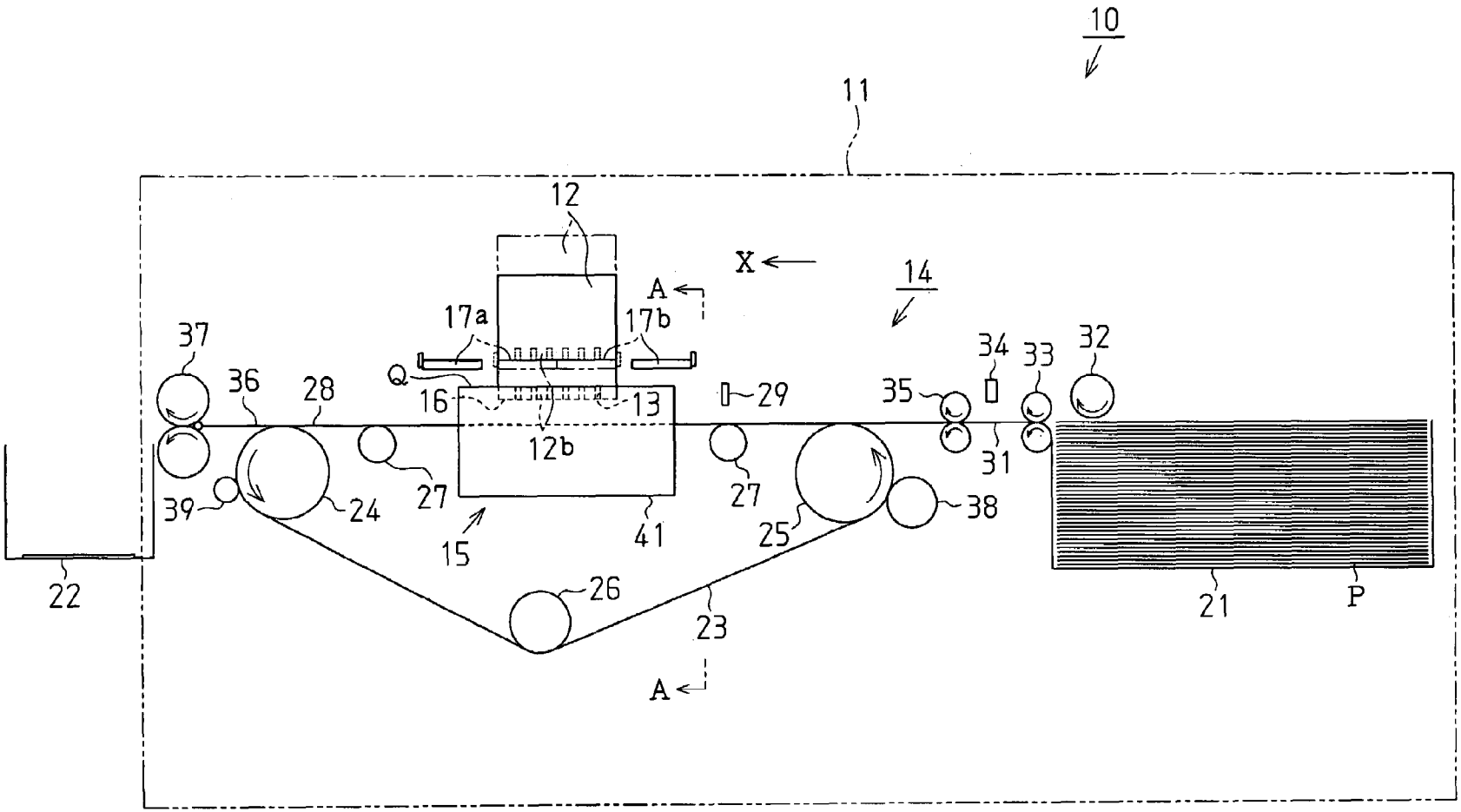
FIG. 1 is a view schematically showing an inkjet printer according to an embodiment of the present invention as a whole in a printing state.

As shown in FIG. 1, an inkjet printer (hereinafter, referred to as a "printer") 10, which is a liquid ejection apparatus of the present embodiment, includes a body casing 11 having a substantially box-like shape. A recording head 12 (a liquid ejection head) is provided substantially at the center of the space in the body casing 11. The recording head 12 ejects ink (liquid) onto a recording paper sheet P as a target.

A plurality of nozzles 13 are formed in a bottom surface of the recording head 12, or a nozzle surface 16. The nozzles 13 are aligned along the entire width of a printing area of the recording paper sheet P and in a direction crossing the transport direction of the recording paper sheet P (indicated by arrow X of FIG. 1). The recording head 12 is thus prevented from reciprocating in the direction crossing the transport direction of the recording paper sheet P when the printer 10 is printing. In other words, the printer 10 of the present embodiment is a full-line head type printer that increases the speed of printing, not a type having a recording head formed on a bottom surface of a carriage that reciprocates in the direction crossing the transport direction of the recording paper sheet P. In the following description, the direction indicated by arrow X represents a leftward direction and the direction opposite to the direction indicated by arrow X represents a rightward direction.

A plurality of ink cartridges (not shown) retaining different color inks are connected to the recording head 12. When the printer 10 is printing, the ink in the ink cartridges is supplied to the recording head 12 as needed under pressure adjusted to a predetermined level. By driving a recording head moving mechanism 12*a* (see FIG. 4), the recording head 12 is enabled to move upward or downward, or toward or separately from a paper transport surface (a target transport surface) 28. The paper transport surface 28 is opposed to the nozzle surface 16 of the recording head 12 and spaced from the nozzle surface 16 at a predetermined distance. The recording head moving mechanism 12*a* includes, for example, two guide rods, two eccentric pins, and a gear mechanism. The guide rods support the recording head 12 at a position in the body casing 11. Each of the eccentric pins is formed in the corresponding one of the guide rods. The eccentric pins are provided eccentrically in a common direction and rotatably secure the corresponding guide rods to the body casing 11. The eccentric pins are connected together by the gear mechanism. When one of the guide rods is rotated about the associated eccentric pin, the other eccentric pin is rotated in the same direction through the gear mechanism. This enables the guide rods to move the recording head 12 upward or downward.

In the body casing 11, caps (cap members) 17*a*, 17*b* are deployed at opposing left and right sides of the recording head 12. The caps 17*a*, 17*b* seal the nozzle surface 16 when cleaning is performed by drawing ink and bubbles from inside the nozzles 13 of the recording head 12 as waste ink (waste liquid). Each of the caps 17*a*, 17*b* has a rectangular box-like shape having a closed bottom. The caps 17*a*, 17*b* are moved in a horizontal direction (leftward or rightward along the paper transport surface 28) by actuating a cap moving mechanism 17*c* (see FIG. 4). The caps 17*a*, 17*b* thus seal the nozzle surface 16 of the recording head 12 from below. The cap moving mechanism 17*c* may include, for example, a ball screw combined with a pair of ball screw nuts (none is shown). The ball screw is driven to rotate by a motor. The ball screw nuts are engaged with the ball screw and connected to the corresponding caps 17*a*, 17*b*. The ball screw nuts thus move toward or separately from each other at positions above the ball screw, when the ball screw is rotated.

Specifically, when the printer 10 performs cleaning, the recording head moving mechanism 12*a* is actuated to raise the recording head 12 until the nozzle surface 16 reaches a cleaning position (indicated by the corresponding alternate long and two short dashes of FIG. 1). The height of the cleaning position of the nozzle surface 16 corresponds to the height of the position at which the caps 17*a*, 17*b* move horizontally. In this state, as indicated by the corresponding alternate long and two short dashes of FIG. 1, the cap 17*a* and the cap 17*b* are located at the left side and the right side, respectively, of the recording head 12. The cap 17*a* and the cap 17*b* then move horizontally rightward and leftward, respectively. The cap 17*a* and the cap 17*b* thus seal the left half and the right half, respectively, of the nozzle surface 16 of the recording head 12. As will be explained later, in the illustrated embodiment, the recording head 12 is movable upward or downward and between the cleaning position, or an uppermost position, and a printing position (indicated by the corresponding solid lines of FIG. 1), or a lowermost position. A flushing position (the position of FIG. 2B) is set between the cleaning position and the printing position.

A paper transport mechanism (a target transport mechanism) 14 and a flushing belt moving mechanism (a liquid receiving member moving mechanism) 15 are arranged below the recording head 12 in the body casing 11. The paper transport mechanism 14 transports the recording paper sheet P. The flushing belt moving mechanism 15 moves a flushing belt 41, or a liquid receiving member. The flushing belt 41 is an endless belt that receives the ink ejected from the nozzles 13 in flushing, which is ink ejection performed independently from printing. The flushing belt 41 thus has an appropriate level of absorption property. In the illustrated embodiment, flushing is carried out after a predetermined time elapses in printing.

The paper transport mechanism 14 includes a paper feeder tray 21, a paper outlet tray 22, and a transport belt 23. The paper feeder tray 21 accommodates a plurality of recording paper sheets P in a stacked state. The paper outlet tray 22 receives the recording paper sheets P after printing. After receiving a recording paper sheet P that has been fed from the paper feeder tray 21, the transport belt 23 transports the recording paper sheet P in a transport direction along a path including a position immediately below (opposed to) the nozzle surface 16 of the recording head 12. The transport belt 23 includes a drive roller 24, a driven roller 25, and a tension roller 26. The drive roller 24 is actuated after printing is started. The driven roller 25 is located at a height equal to the height of the drive roller 24 and driven to rotate by the drive roller 24. The tension roller 26 is arranged below the position intermediate between the drive and driven rollers 24, 25. The transport belt 23 is suspended by the rollers 24, 25, 26 in a strained state. In other words, the drive roller 24, the driven roller 25, and the tension roller 26 are arranged in such a manner that, when the transport belt 23 is wound around the three rollers 24, 25, 26, the transport belt 23 forms a triangular shape.

A plurality of (in the illustrated embodiment, two) auxiliary transport rollers 27 are provided between the drive roller 24 and the driven roller 25. The transport belt 23 has a portion that is supported in a horizontal state by the auxiliary transport rollers 27 from below at a position between the drive roller 24 and the driven roller 25. The upper surface of this portion forms the paper transport surface 28. A printing start sensor 29 is deployed at a position closer to the paper feeder tray 21 than the recording head 12 and above the paper transport surface 28. Specifically, a recording paper sheet P is transported leftward (a target transport direction) from the position of the printing start sensor 29 to a printing position immediately below the nozzle surface 16 of the recording head 12. The printing start sensor 29 provides a start point for measuring the amount of transport of the recording paper sheet P.

A first guide plate 31 is arranged between the paper feeder tray 21 and the transport belt 23. The first guide plate 31 guides the recording paper sheet P from the paper feeder tray 21 to an end (the right end as viewed in FIG. 1 corresponding to the driven roller 25) of the paper transport surface 28. A pickup roller 32 is arranged above the paper feeder tray 21 to retrieve an uppermost recording paper sheet P from the paper feeder tray 21. A pair of separation rollers 33 are provided at a connecting portion of the paper feeder tray 21 and the first guide plate 31. Specifically, friction may cause the pickup roller 32 to pick up multiple recording paper sheets P at the same time in an overlapping state. If this is the case, the separation rollers 33 operate to reliably send a recording paper sheet P one at a time, separately from the rest of the recording paper sheets P.

A sheet end sensor 34 is deployed above the first guide plate 31 to detect a recording paper sheet P that has been passed between the separation rollers 33. A pair of gate rollers 35 are also provided and actuated for sending the recording paper sheet P from the first guide plate 31 to the paper transport surface 28. Specifically, the pickup roller 32, the separation rollers 33, and the gate rollers 35 rotate in a direction in which a recording paper sheet P is sent to the paper transport surface 28 (the direction indicated by arrow of FIG. 1). This supplies the recording paper sheet P from the paper feeder tray 21 to the paper transport surface 28.

A second guide plate 36 is provided between the transport belt 23 and the paper outlet tray 22. The second guide plate 36 guides the recording paper sheet P from an opposing end (the left end as viewed in FIG. 1 corresponding to the drive roller 24) of the paper transport surface 28 to the paper outlet tray 22. A pair of outlet rollers 37 are arranged between a basal end of the second guide plate 36 and the paper outlet tray 22. After printing, the outlet rollers 37 operate to send the recording paper sheet P to the paper outlet tray 22. In other words, through rotation of the transport belt 23 and the outlet rollers 37, the printed recording paper sheet P is removed from the paper transport surface 28 and provided to the paper outlet tray 22.

A charging roller 38 is arranged in correspondence with the driven roller 25 in such a manner as to clamp the transport belt 23 between the circumferential surfaces of the charging roller 38 and the driven roller 25. A neutralizing roller 39 is arranged in correspondence with the drive roller 24 in such a manner as to clamp the transport belt 23 between the circumferential surfaces of the drive roller 24 and the neutralizing roller 39. The charging roller 38 negatively charges the corresponding surface of the transport belt 23, which supports the recording paper sheet P. The recording paper sheet P is thus adsorbed and held by the paper transport surface 28 of the transport belt 23.

Figure 2A:
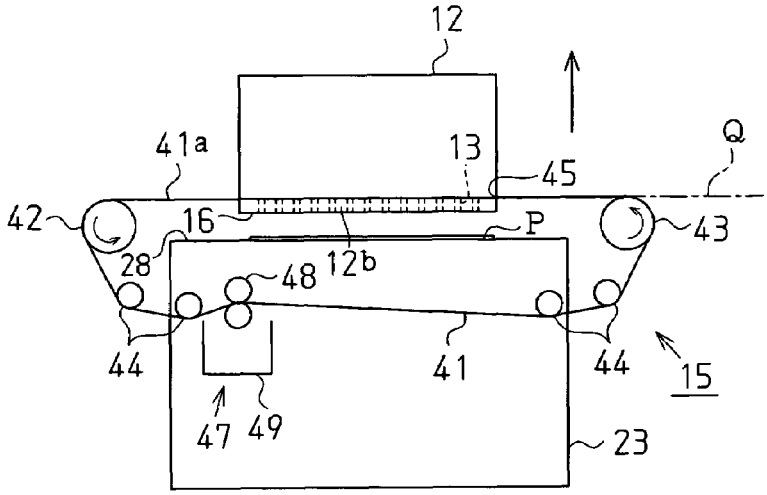
FIG. 2A is a cross-sectional view taken along line A-A of FIG. 1, schematically showing a flushing belt mechanism of the printer in a printing state.
Figure 2B:
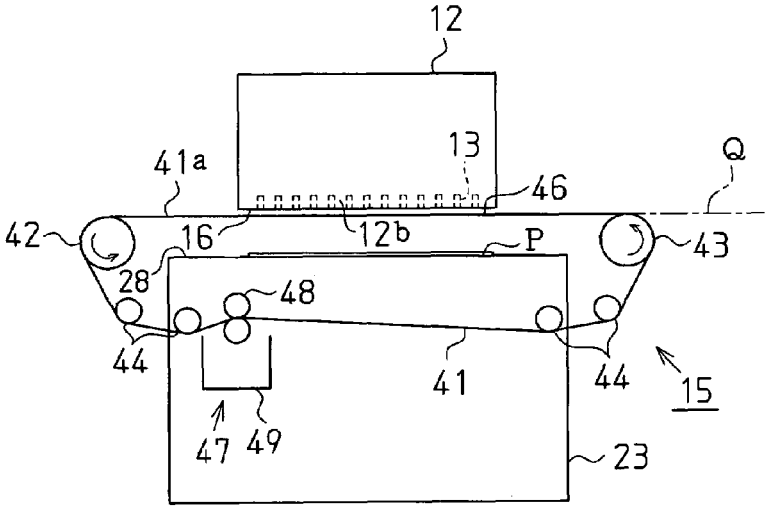
FIG. 2B is a cross-sectional view taken along line A-A of FIG. 1, schematically showing the flushing belt mechanism of the printer in a flushing state.

Each of FIGS. 2A and 2B is a cross-sectional view taken along line A-A of FIG. 1 schematically showing a flushing belt mechanism. In FIGS. 2A and 2B, for the illustrative purposes, the caps 17*a*, 17*b*, the tension roller 26, the auxiliary transport rollers 27, the second guide plate 36, the outlet rollers 37, and the paper outlet tray 22 are omitted from the drawings.

Referring to FIGS. 2A and 2B, the flushing belt moving mechanism 15 includes the flushing belt 41, or the endless belt. The flushing belt moving mechanism 15 has a flushing belt drive roller 42, a flushing belt driven roller 43, and a plurality of (in the illustrated embodiment, four) tension rollers 44. The flushing belt drive roller 42 is actuated when flushing is started. The flushing belt driven roller 43 is located at a height equal to the height of the flushing belt drive roller 42 and driven to rotate by the flushing belt drive roller 42. The tension rollers 44 are provided between and below the flushing belt drive and driven rollers 42, 43. The flushing belt 41 is suspended by the rollers 42, 43, 44 in a strained state.

The flushing belt drive roller 42, the flushing belt driven roller 43, and the tension rollers 44 are arranged in such a manner as to rotate about an axis extending along the transport direction of the recording paper sheet P (the leftward direction), which is transported by the transport belt 23. The flushing belt 41 is suspended by the rollers 42, 43, 44 to define a substantially rectangular loop. In this state, through rotation of the rollers 42, 43, 44, the flushing belt 41 is caused to revolve along a path including the opposing sides of the paper transport surface 28 of the transport belt 23 of the paper transport mechanism 14.

Figure 3:
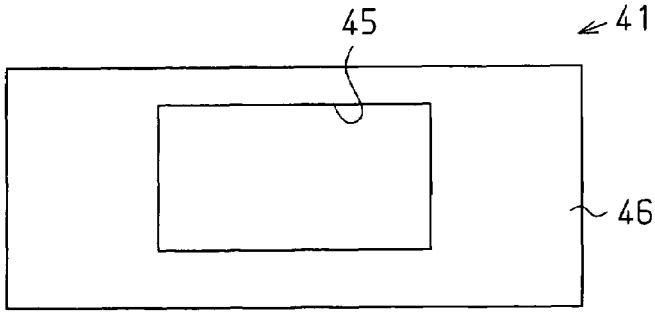
FIG. 3 is a plan view showing a flushing belt.

With reference to FIG. 3, a rectangular opening 45 is defined in a portion of the flushing belt 41. A portion of the flushing belt 41 opposed to the nozzle surface 16 other than the portion corresponding to the opening 45 functions as an ink receiving portion 46 (a liquid receiving portion) in flushing. The opening 45 is sized sufficiently large for receiving a lower end (an end) 12*b* of the recording head 12 at which the nozzle surface 16 is formed. In other words, the opening 45 is sized correspondingly to the size of the nozzle surface 16. Referring to FIG. 2B, the flushing belt moving mechanism 15 moves the flushing belt 41 along a movement plane Q, which is defined between the nozzle surface 16 of the recording head 12 located at the flushing position and the paper transport surface 28 of the paper transport mechanism 14.

A cleaning mechanism 47 is provided in the movement path of the flushing belt 41 (specifically, a portion of the path corresponding to the backside of the paper transport surface 28 of the paper transport mechanism 14). The cleaning mechanism 47 removes the ink from the ink receiving portion 46 after flushing. The cleaning mechanism 47 includes a pair of pressure rollers 48 and a retainer casing 49 having a box-like shape with a closed bottom. The pressure rollers 48 clamp the flushing belt 41 in a pressed state, thus squeezing the ink off from the flushing belt 41. The retainer casing 49 has an upper opening through which the ink drops into the retainer casing 49. That is, when the flushing belt 41 passes between the pressure rollers 48, the ink that has been absorbed by the flushing belt 41 is squeezed off from the flushing belt 41 by the pressure rollers 48 and received by the retainer casing 49. The retainer casing 49 retains the received ink.

The electric configuration of the printer 10 will hereafter be explained with reference to FIG. 4.

Figure 4:
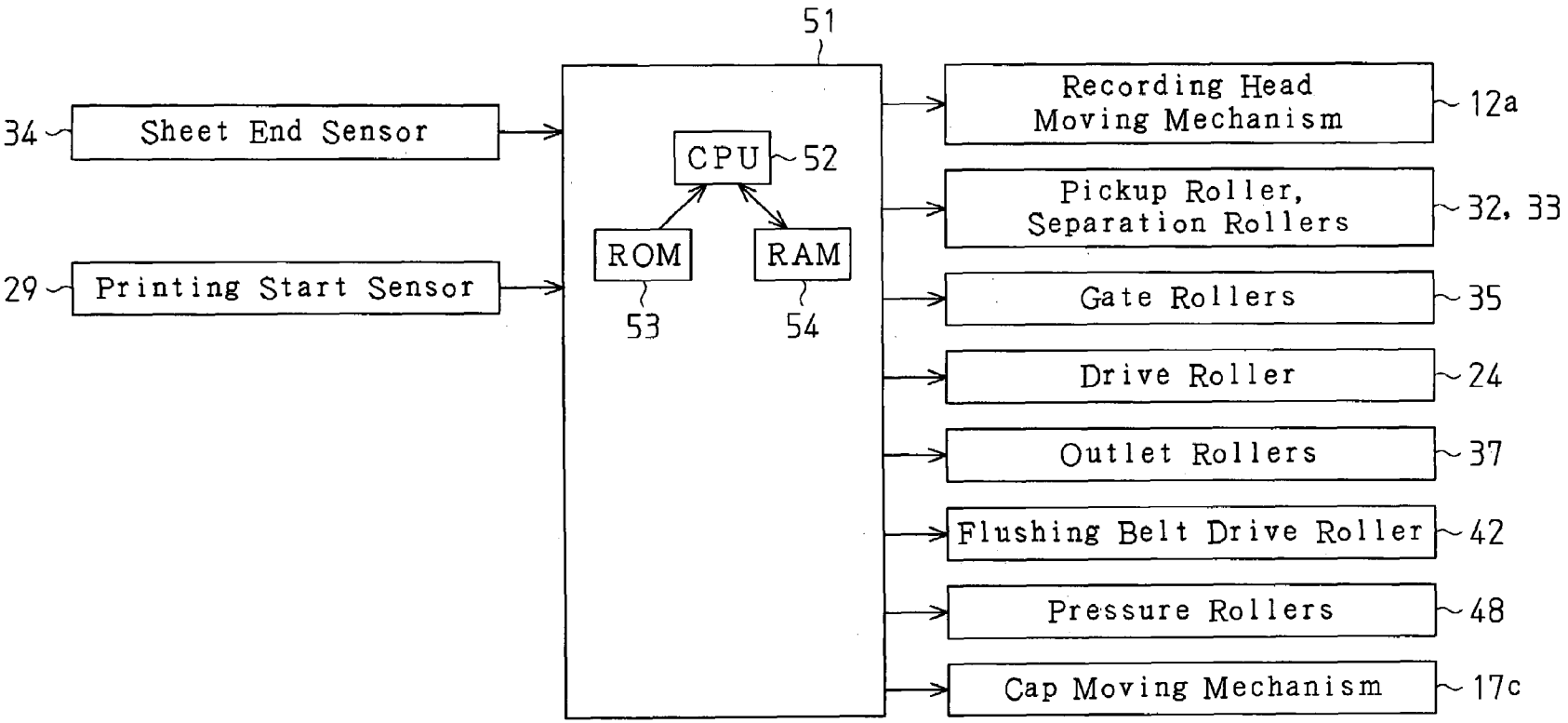
FIG. 4 is a block diagram representing the electric configuration of the printer.

As illustrated in FIG. 4, the printer 10 has a controller 51 (omitted from FIG. 1 for the illustrative purposes) including a CPU 52. A ROM 53 and a RAM 54 are connected to the CPU 52. The ROM 53 stores, for example, a control program in accordance with which the recording head 12 is operated when the ink is ejected (discharged) to the recording paper sheet P or the flushing belt 41. The RAM 54 stores and manages various types of information (including detection signals of the sensors), which is rewritten as needed in operation of the printer 10.

The sheet end sensor 34 and the printing start sensor 29 are electrically connected to the input of the controller 51. The recording head moving mechanism 12*a*, the pickup roller 32, the separation rollers 33, the gate rollers 35, the drive roller 24, the outlet rollers 37, the flushing belt drive roller 42, the pressure rollers 48, and the cap moving mechanism 17*c* are electrically connected to the output of the controller 51. In correspondence with detection signals generated by the sensors 34, 29 connected to the input of the controller 51, the CPU 52 controls operation of the components (such as the drive roller 24) connected to the output of the controller 51.

Operation of the printer 10, particularly in flushing, will hereafter be explained.

To start printing, the CPU 52 operates to rotate the pickup roller 32, the separation rollers 33, the gate rollers 35, the drive roller 24, and the outlet rollers 37. In this manner, the uppermost recording paper sheet P is retrieved from the paper feeder tray 21 and sent to the paper transport surface 28 through the first guide plate 31. In correspondence with a detection signal of the printing start sensor 29, the recording paper sheet P is transported accurately to the position (the printing position) opposed to the nozzle surface 16 of the recording head 12. In this state, the lower end 12*b* of the recording head 12, at which the nozzle surface 16 is provided, is received in the opening 45 of the flushing belt 41 maintained in a stopped state. The nozzle surface 16 is thus located below a horizontal surface 41*a* of the flushing belt 41, which is supported horizontally along the movement plane Q. The recording paper sheet P is arranged between the nozzle surface 16 of the recording head 12 and the transport belt 23. In this state, the ink is ejected from the nozzles 13 of the recording head 12 onto the recording paper sheet P, thus recording predetermined print data on the recording paper sheet P (printing).

In printing, flushing is initiated after a predetermined time. Specifically, the CPU 52 actuates the recording head moving mechanism 12*a* to raise the recording head 12 to the flushing position. The flushing position corresponds to the substantial middle position between the lowermost position of the movement range of the recording head 12, or the printing position, and the uppermost position in the movement range, or the cleaning position. As illustrated in FIG. 2B, when the recording head 12 is held at the flushing position, the nozzle surface 16 of the recording head 12 is located above the horizontal surface 41*a* of the flushing belt 41.

Subsequently, the CPU 52 operates to rotate the flushing belt drive roller 42 in the direction indicated by the arrows of FIGS. 2A and 2B. At this stage, since the recording head 12 has been raised to the position above the horizontal surface 41*a* of the flushing belt 41, a sufficiently large clearance exists between the nozzle surface 16 of the recording head 12 and the horizontal surface 41*a* of the flushing belt 41. This prevents the flushing belt 41 from contacting and sliding on the nozzle surface 16 of the recording head 12 when revolving, allowing the flushing belt 41 to move smoothly. In this state, the flushing belt 41 is revolved until the ink receiving portion 46 of the flushing belt 41 reaches the position immediately below (opposed to) the nozzle surface 16. At this point, the flushing belt drive roller 42 is stopped. The ink is then ejected from the nozzles 13 of the recording head 12 and received by the ink receiving portion 46 (flushing).

To resume printing, the above-described operation is repeated in a reversed manner. Specifically, the flushing belt drive roller 42 is re-actuated to revolve the flushing belt 41 until the opening 45 reaches the position opposed to the nozzle surface 16 of the recording head 12. Such revolution of the flushing belt 41 may be brought about in the same direction as the revolving direction of the flushing belt 41 when flushing is started (the direction indicated by the arrows of FIGS. 2A and 2B) or the opposite direction. Afterward, the recording head moving mechanism 12*a* is actuated to lower the recording head 12 through the opening 45 in such a manner that the nozzle surface 16 is moved from the flushing position to the printing position.

As has been described, in printing of the illustrated embodiment, the nozzle surface 16 of the recording head 12 is held at the printing position (the lowermost position) below the horizontal surface 41*a* of the flushing belt 41. In this state, the nozzle surface 16 is arranged closest to the recording paper sheet P through the opening 45 of the flushing belt 41. In flushing, the nozzle surface 16 of the recording head 12 is located at the flushing position above the horizontal surface 41*a* of the flushing belt 41. In this state, the nozzle surface 16 opposes the ink receiving portion 46 of the flushing belt 41. That is, the flushing position, at which the nozzle surface 16 of the recording head 12 is located in flushing, is more spaced from the paper transport surface 28 of the paper transport mechanism 14 than the printing position. The nozzle surface 16 is thus sufficiently spaced from the horizontal surface 41*a* of the flushing belt 41 when flushing is performed. This prevents the flushing belt 41 from contacting and sliding on the nozzle surface 16 of the recording head 12. Accordingly, the flushing belt 41 stably revolves.

The illustrated embodiment has the following advantages.

(1) In the illustrated embodiment, the recording head moving mechanism 12*a* is actuated to raise the recording head 12 before revolving the flushing belt 41. In other words, the recording head 12 is raised to the flushing position spaced upwardly from the horizontal surface 41*a* of the flushing belt 41 at a sufficient distance (interval). The nozzle surface 16 is thus sufficiently spaced from the flushing belt 41. This prevents the flushing belt 41 from contacting and sliding on the nozzle surface 16 of the recording head 12 when revolving. The flushing belt 41 is thus allowed to smoothly move. In printing, the recording head 12 is lowered by the recording head moving mechanism 12*a* in such a manner as to bring the nozzle surface 16 sufficiently close to the recording paper sheet P. This prevents running of the ink that has been ejected onto the recording paper sheet P, enhancing printing accuracy.

(2) In the illustrated embodiment, the nozzle surface 16 of the recording head 12 is located below the horizontal surface 41*a* of the flushing belt 41 when printing is carried out. That is, the recording head 12 is lowered to the printing position at which the nozzle surface 16 and the recording paper sheet P become closest to each other as opposed to each other. Printing is thus performed further stably.

(3) The flushing belt 41 of the illustrated embodiment is an endless belt. Thus, by revolving the flushing belt 41 in one direction (counterclockwise, in the illustrated embodiment), the portion of the flushing belt 41 opposing the nozzle surface 16 of the recording head 12 is easily switched from the opening 45 to the ink receiving portion 46 or from the ink receiving portion 46 to the opening 45 in sequential manners.

(4) In the illustrated embodiment, the cleaning mechanism 47 removes the ink from the ink receiving portion 46 of the flushing belt 41. This prevents the ink received by the ink receiving portion 46 of the flushing belt 41 from contaminating other components of the printer 10. The flushing belt 41 thus can be used continuously.

(5) In the illustrated embodiment, the recording head 12 is moved to the uppermost position, or the cleaning position, when cleaning is performed. This ensures a sufficiently large clearance between the nozzle surface 16 and the flushing belt 41. The caps 17*a*, 17*b* are thus easily inserted into the clearance.

The present invention may be embodied in the following modified forms (modified embodiments).

The cleaning mechanism 47 of the illustrated embodiment may remove the ink from the flushing belt 41 by wiping, drawing, or blowing off the ink from the flushing belt 41.

In the illustrated embodiment, the flushing belt 41, or the liquid receiving member, may be formed by a single sheet-like member that is reciprocated rightward and leftward, instead of the endless (annular) belt. Also in this case, the sheet-like member is reciprocated by the liquid receiving member moving mechanism to switch the portion of the sheet-like member opposing the nozzle surface 16 between the opening 45 and the ink receiving portion 46. This ensures advantages equivalent to those described in the items (1), (2), (4), and (5).

In the illustrated embodiment, the printing position of the recording head 12 may be set in such a manner that the nozzle surface 16 is located at a height equal to the height of the horizontal surface 41*a* of the flushing belt 41 or slightly higher than the horizontal surface 41*a*.

In the illustrated embodiment, the opening 45 may be sized and shaped in any suitable manners as long as the opening 45 is larger than the nozzle surface 16 of the recording head 12 and thus the nozzle surface 16 is allowed to pass through the opening 45.

The present invention may be applied to a printer that is not a full-line head type.

In the illustrated embodiment, the liquid ejection apparatus is embodied as the printer 10, which ejects ink. However, any other different liquid ejection apparatuses may be embodied as the liquid ejection apparatus of the present invention. These liquid ejection apparatuses include printing devices including facsimiles and copiers, liquid ejection apparatuses ejecting liquid of electrode material or color material used for manufacturing liquid crystal displays, EL displays, and surface emission displays, liquid ejection apparatuses ejecting biological organic matter for manufacturing biochips, and sample ejection devices as precision pipettes. Further, the liquid ejected by the liquid ejection apparatus of the present invention is not restricted to the ink but may be any other type of liquid.

What is claimed is:

1. A liquid ejection apparatus comprising:

a liquid ejection head having a nozzle surface, a plurality of liquid ejection nozzles being provided in the nozzle surface, the liquid ejection head ejecting a liquid from the liquid ejection nozzles to a target transported along a target transport surface opposed to the nozzle surface;

a liquid receiving member including an opening and a portion other than the opening, the opening being larger than the nozzle surface, the portion of the liquid receiving member other than the opening functioning as a liquid receiving portion that receives the liquid ejected from the liquid ejection nozzles in flushing;

a liquid receiving member moving mechanism that moves the liquid receiving member along a movement plane defined between the nozzle surface and the target transport surface, wherein, in printing, the liquid receiving member moving mechanism moves the liquid receiving member until the opening faces the nozzle surface, and wherein, in the flushing, the liquid receiving member moving mechanism moves the liquid receiving member until the liquid receiving portion faces the nozzle surface; and a liquid ejection head moving mechanism that moves the liquid ejection head to move the nozzle surface close to or separately from the target transport surface, wherein, in the printing, the liquid ejection head moving mechanism moves the liquid ejection head until the nozzle surface reaches a printing position close to the target transport surface and wherein, in the flushing, the liquid ejection head moving mechanism moves the liquid ejection head until the nozzle surface reaches a flushing position spaced from the target transport surface;

wherein, to deploy the nozzle surface at the printing position, the liquid ejection head moving mechanism moves the liquid ejection head in such a manner as to pass an end of the liquid ejection head corresponding to the nozzle surface through the opening of the liquid receiving member, thereby bringing the nozzle surface closer to the target transport surface than the movement plane.

2. The apparatus according to claim 1, wherein the liquid ejection nozzles are arranged along the entire width of a liquid ejection area of the target and in a direction crossing a transport direction of the target.

3. The apparatus according to claim 1, further comprising a cap member, wherein, in cleaning, the liquid ejection head moving mechanism moves the liquid ejection head until the nozzle surface reaches a cleaning position more spaced from the target transport surface than the flushing position, and wherein the cap member seals the nozzle surface of the liquid ejection head when the nozzle surface is arranged at the cleaning position.

4. The apparatus according to claim 1, wherein the liquid receiving member is an endless belt that revolves along opposing sides of the target transport surface.

* * * * *